US005470427A

United States Patent [19]

Mikel et al.

[11] Patent Number: 5,470,427

[45] Date of Patent: Nov. 28, 1995

[54] POSTAL AUTOMATED LABELING SYSTEM

[75] Inventors: Dennis A. Mikel, Vandelia; Richard H. Rosen, Dayton, both of Ohio

[73] Assignee: Pitney Bowes Inc., Stamford, Conn.

[21] Appl. No.: 181,476

[22] Filed: Dec. 29, 1993

Related U.S. Application Data

[63] Continuation of Ser. No. 963,013, Oct. 19, 1992, abandoned, which is a continuation of Ser. No. 641,985, Jan. 16, 1991, abandoned.

[51] Int. Cl.[6] ..... B65C 9/18

[52] U.S. Cl. ..... 156/387; 156/577; 156/579; 209/900

[58] Field of Search ..... 156/361, 384, 156/577, 579, 387; 101/288; 221/9, 73; 209/900

[56] References Cited

U.S. PATENT DOCUMENTS

| | | | |
|---|---|---|---|
| 4,264,396 | 4/1981 | Stewart | 156/361 |
| 4,578,138 | 3/1986 | Hamisch, Jr. et al. | 156/361 |
| 4,584,047 | 4/1986 | Vander pool et al. | 156/361 |
| 4,652,317 | 3/1987 | Seestrom | 156/384 X |
| 4,706,096 | 11/1987 | Sato | 156/579 X |

FOREIGN PATENT DOCUMENTS 0095737 12/1983 European Pat. Off. .

*Primary Examiner*—James Engel
*Assistant Examiner*—J. Sells
*Attorney, Agent, or Firm*—Ronald Reichman; Melvin J. Scolnick

[57] ABSTRACT

A system is shown and described wherein a portable printer is used to produce tags for attachment to mail trays. The printer is uploaded with plans that are the same as sort plans stored in the memory of a sorting machine with which the printer is to be used. The same sort plan that is selected for operation of the sorting machine will be input into the printer so that tags can be printed and attached to mail trays on an as needed basis. These tags can be colored coded so that the targeted day of delivery of the mail can be indicated. Act tags can be printed by scanning the mail tray tags.

3 Claims, 3 Drawing Sheets

POSTAL AUTOMATED LABELING SYSTEM

This application is a continuation of application Ser. No. 07/963,013, filed Oct. 19, 1992 which in turn is a continuation of application Ser. No. 07/641,985, filed Jan. 16, 1991.

BACKGROUND OF THE INVENTION

The U.S. postal service has implemented a bar coding system for automating the processing of mail from its point of receipt to the destination letter carrier. In the process of implementing this bar coding system, the postal service relies on pre-printed labels and tags for the identification of the trays of mail that are moved through its system. As mail is received in a post office, it is sorted in a number of steps. There are two sources of mail that are processed by a post office: mail that is collected locally and mail that is received from another postal facility for a finer sortation. The mail that is received locally will be sorted in a three phase sortation in accordance with geographical distribution. In the first sortation, local mail will be separated from regional and state mail, with the local mail remaining at that post office or forwarded to another local post office for ultimate receipt by the letter carriers. The out of town mail is sorted geographically and sent to distribution centers for the mail furthest away and to other post offices in other states for further sortation. The mail that is received by a post office from a distribution center will be further sorted for the local delivery.

In any of these sortation schemes, there is generally a sortation plan which is basically a table which designates where specific mail pieces are to be channeled or forwarded.

In order for the mail to be further identified, the postal clerk will place a tag on a tray that indicates the destination of the mail contained in the tray. As now practiced, each post office is provided with a case that holds a large number of pre-printed tags that are segregated in accordance to distinctions of mail pieces and have a color code. The color code is provided so that a different colored tag can be used for different designated delivery days for those mail pieces that are to be sent out of town and a white label for local mail. The colored tag scheme allows a receiving clerk at a downstream operation to determine the targeted delivery day of that tray so as to give preference to more time sensitive mail. As one can imagine, a large number of tags are required to process the mail from day to day.

The present pre-printed tags have certain drawbacks. A clerk will often run out of tags and must order the same from a centralized location. The lead time to order such tags normally is from 4–6 weeks. The use of so many tags requires stock rooms and clerks to administer the stock rooms. The cost of the tags is high and there is a great deal of waste because obsolete tags are discarded.

Obviously, it would be beneficial to provide a system for tagging trays, sacks, and the like in a more efficient and economic manner.

SUMMARY OF THE INVENTION

The tray labeling system of the instant invention utilizes a device such as a thermal printing electronic labeler, as for example a PATHFINDER® 6080™ Labeler, available from Monarch Marking Systems. The bar code sort plan is downloaded from a personal computer and maintained in the memory of the labeler. This sort plan number is consistent with the predetermined sort plans which are used to separate mail on a bar code sorter.

At the beginning of a sorting operation, the operator selects the correct sort plan and inputs that sort plan into both the sorting machine and the labeler. After the sort plan is selected, the operator initiates a sequence to produce an initial tag for each of the trays. Sorting is started and as mail trays become full, a new tag will be printed by scanning a bar coded label on the associated bin, the new tags will be attached to a replacement tray and the full tray will be removed and replaced with the newly tagged tray.

As the operation continues, those mail pieces that are to be sent to distribution centers, as opposed to local mail, are forwarded to what is know as an air contract transportations (ACT) station where the mail is prepared for shipment to an airport. In such preparation, trays are placed in sleeves and the sleeved mail is given a second label by scanning the tray tag with a wand or laser scanner which is connected to a printer that is programmed to print an ACT tag (label).

DETAIL DESCRIPTION OF THE PREFERRED EMBODIMENT

Figure 1:
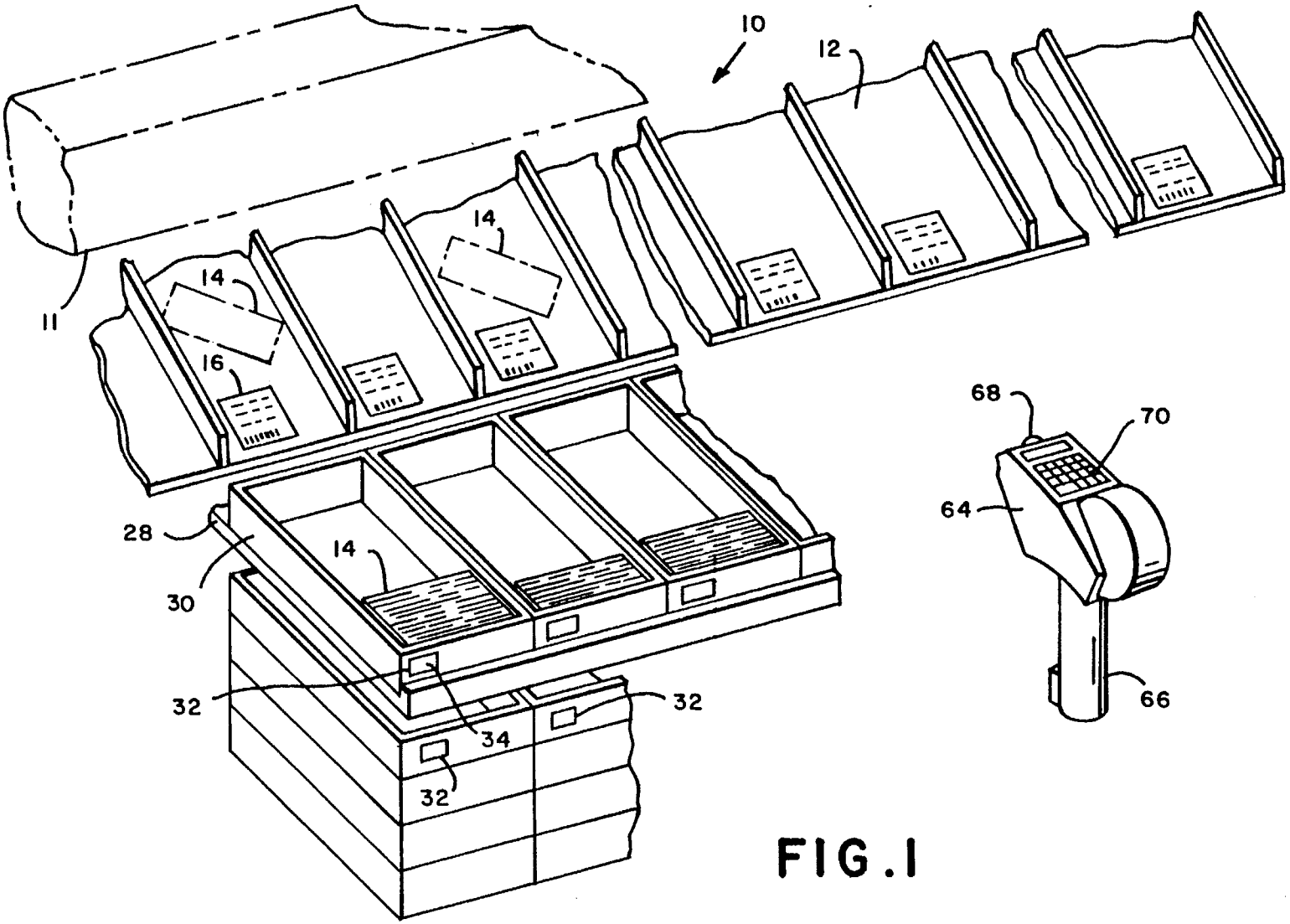
FIG. 1, is a perspective view showing portions of a post office sorting device with which the instant invention can be used.
Figure 2A:
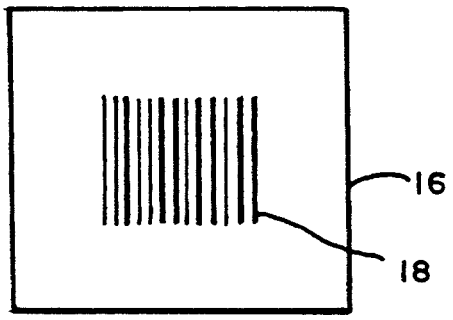
FIGS. 2A–2C, are plan views of tags and labels that are printed in accordance with the instant invention.

With reference to the FIG. 1, a sorting system is partially shown generally at 10 and includes a sorting machine 11. Although any type of sorting machine can be used, as a generally rule the sorter will be one capable of reading the address block of mail pieces or a bar code on the mail pieces and, as a result of the reading placing the mail pieces in bins according to their respective destinations. An example of such a sorting machine are a Pitney Bowes OCR/CS sorter or a bar code sorter (BCS) presently used by the postal service for sorting mail. The sorting machine 11 will have a multiplicity of bins 12, as for example 96, but only a few are shown for purposes of clarity. The bins 12 will receive the mail pieces 14 that are sorted according to the sort plan selected for the sorting machine 11. The bin label 16, see FIG. 2*a*, has a bar code that will identify the bin number. (The bar code may be one of any number of conventional bar codes.

Again referring to FIG. 1, a platform 28 is located adjacent to the bins 12 and support trays 30 into which mail pieces 14 from the respective bins 12 are placed. It will be appreciated that it is the normal practice in the post office that the mail pieces 14 are placed into the trays 30 and stacked by a postal clerk. The postal clerk will also assure there are no jams in the sorting machine 11. There will be as many trays 30 supported by the platform 28 adjacent to the bins 12 as there are bins. Each of the trays 30 will have a tag holder 32 for the receipt of a tag 34. Located below the platform are a plurality of empty trays 30 that are maintained for the purpose of replacing trays 30 on the platform as the original trays are filled with mail.

Figure 2B:
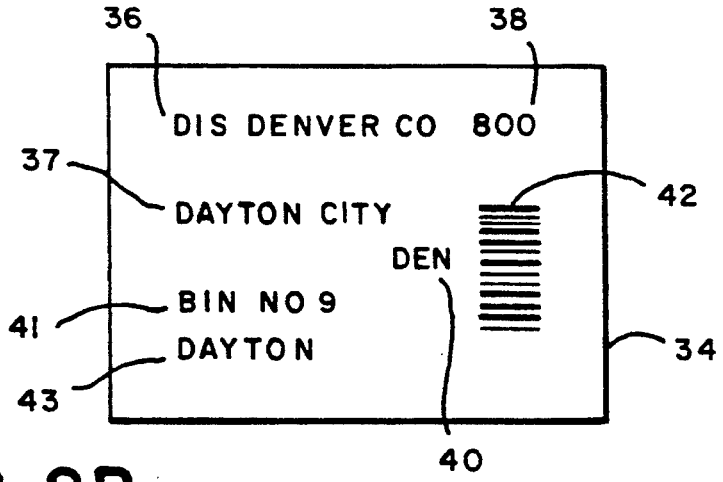

With reference to FIG. 2*b*, the tag 34 that will be placed within a tray location 32 can contain a variety of information in accordance with the programming and key selection of the labeller 64. The tag in this case is shown with the destination of the mail 36 in the tray and the first 3 digits of the zip code 38. In addition, the information relative to origin of the mail is shown including the processing post office 37, bin number 41 and originating city 43. The tray tag 34 also has a bar code 42 thereon that repeats the destination information on the tag in bar code form.

Figure 2C:
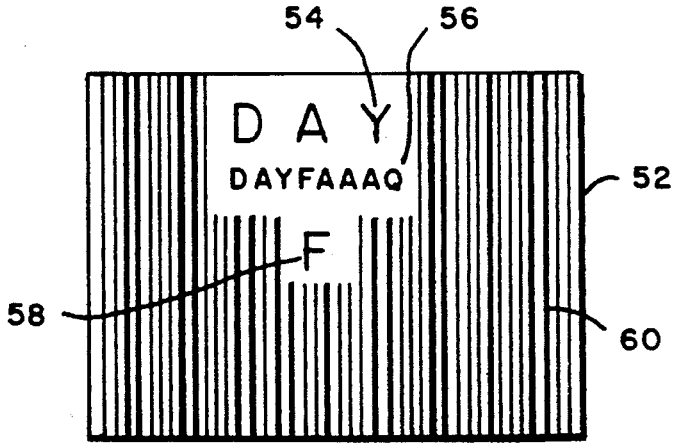

Non-local mail that has been sorted and trayed is sent to an air contract transportation (ACT) station for routing. Each tray is placed in a sleeve which has a label attached thereto for the purpose of identifying the contents of the sleeve. An ACT tag (label) that would be attached to a sleeve is shown in FIG. 2*c*. The label 52 contains the destination 54 of the mail, the carrier in abbreviated form 56 and the class of mail is indicated 58. The ACT tag 52 also contains a bar code 60 that repeats this information in bar code form.

A hand held labeler 64 that can be used in the invention is shown in FIG. 1. This labeler 64 will have a light source 68 that is part of a scanning device and a keyboard 70 for input of data. Such hand held electronic labelers are known, see for example U.S. Pat. No. 4,652,317 and are also commercially available, as for example a Monarch PATHFINDER® Labeler, with a model number 098 scanner interface attached thereto. Such a labeler 64 will be used at the sorting machine 11. The ACT tag 52 preferably will be printed by a table top printer, such as Model no. 9445 Printer available from Monarch Marking Systems, because of the size of the ACT label.

Figure 3:
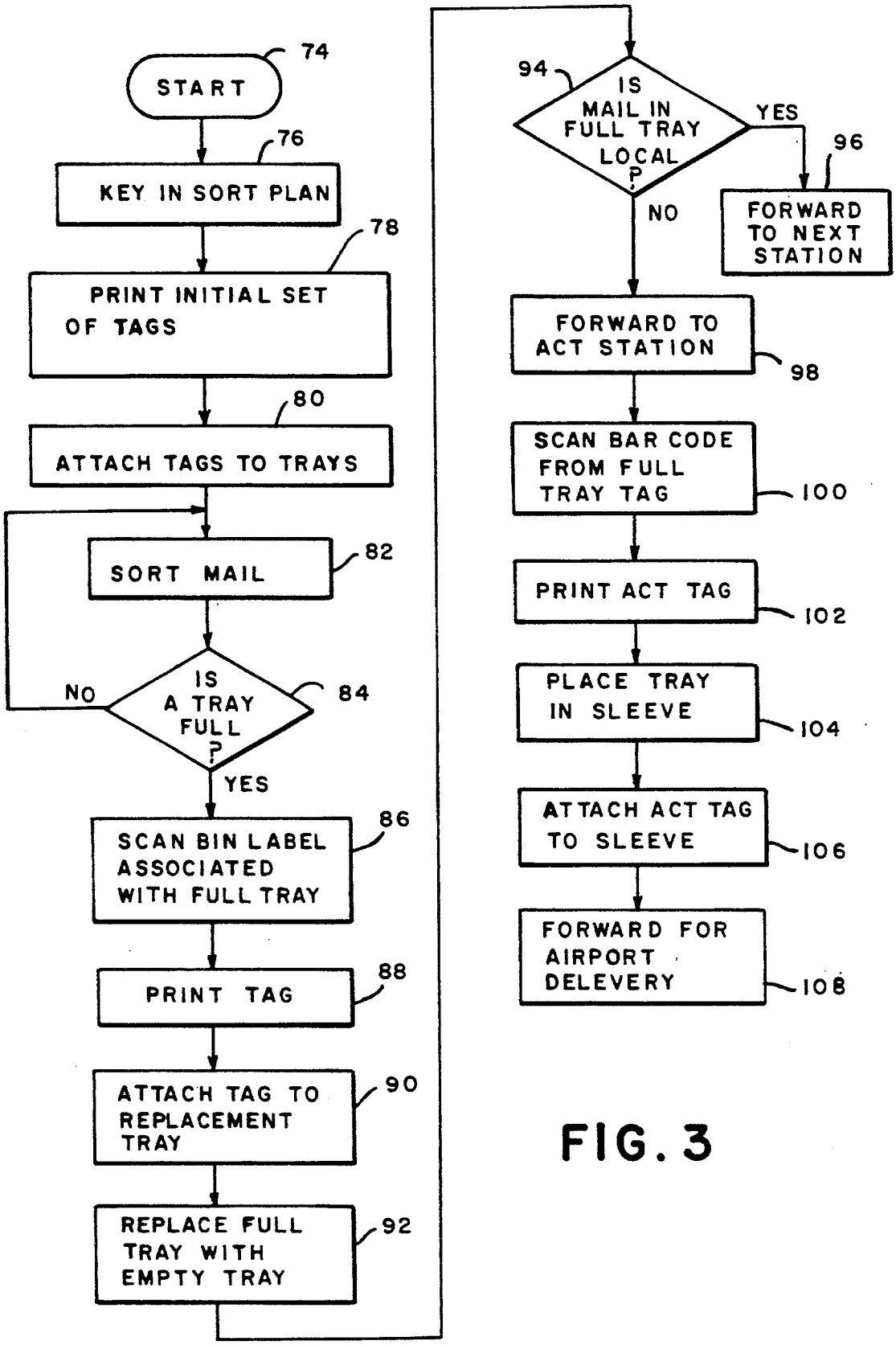
FIG. 3, is a flow chart illustrating the process of the instant invention.

With reference to FIG. 3, the operation will be described. The operation is started 74 by the bar code sorter 11 and labeler 64 being uploaded 76 by the postal clerk with a sort plans that will control the operation of the sorting machine 11 and the printing of tags by the labeler 64. More specifically, the sorter 11 is capable of sorting mail to a number of locations and the particular run to be made by the sorter will depend upon the mail that is loaded on the feeding station thereof. Mail is generally sorted in three passes through entry machines. The first pass will separate local mail, the second mail that is to be delivered about the local area and the third mail that is to be delivered at a further distance. The mail that is received by the sorting machine 11 may have been sorted in a previous pass by one of the post office sort plans. All the mail that is placed at the feed station of the sorting machine may be mail that is destined for western states. The sort plan that is specified for sorting of mail designated for the western states will then be uploaded to the processor of the sorter. The sorter will then process the mail in accordance with that sort plan. Thereafter, the postal clerk will select the same sort plan in the labeler 64 that has been uploaded to the sorter 11 by inputting the sort plan number through the keyboard 70.

With the sort plan keyed in 76 both the sorter 11 and labeler 64, the operator will either generate a complete initial set of labels by input through the keyboard 70 or the operator will scan the bar labels 16 in each of the bins 12. The bar code bin number plus the sort plan number will yield the information contained on the label 16 as discussed previously, which printing may be actuated by the labeler operator. For example, one bin may receive mail to be delivered to a distribution center in Boise, Id., another bin could receive mail destined for Denver, Colo., another bin could receive mail destined for a distribution center in Portland, Oreg., and so forth. Labels 16, such as that shown in FIG. 2b, will be inserted in the holder 32 of each tray 30 located in front of a respective bin 12. Upon completing the initial tagging of the tray 80, the sorting machine is started so as to sort the mail 82. When a tray 30 becomes full, the operator will scan 86 the bin label of the bin associated with the full tray to produce a new tag 88 and will place that tag on an empty tray 90. The full tray will be replaced with the newly tagged empty tray 92. In this way, a tag is produced quickly without the need of going to a centralized tag case to select the appropriate pre-printed tag.

The operator will determine 94 if a full tray contains mail for local delivery 94. Is so, he will forward the mail to another internal station 96 for the third pass of sorting but if not, he will forward the mail to the ACT station 100.

The tags 34 will be part of a web, or sequences of blank tags on a carrier, that is originally loaded into the labeler 64. These tags 34 are of different colors so that on each day the labeler will be supplying label of a distinct color with the exception of tags for local mail which are always white. The reason the post office uses labels of different colors, is so that a postal clerk will recognize the targeted day of delivery. The post office makes an effort to assure that mail is delivered within a prescribed period in different parts of the country. For example, within a given locality the mail is to be delivered overnight. If a postal clerk at a receiving post office sees a label indicating that the mail has to be delivered by a particular day, he will give that mail expedited service so that the mail is delivered as quickly as possible.

The tray 30 with non-local mail is forwarded to the ACT station 98 where the tray tag 34 will be scanned 100 as by a hand held scanner attached to a table top printer. The ACT tag will then be printed 102, the tray placed in a sleeve 104 and banded, and the ACT tag will be attached to the sleeve 106. The sleeve containing the tray 30 of mail will then be forwarded for air delivery. It will be appreciated this activity eliminates the need of an inventory of ACT tags (labels) as was described with reference to tray tags.

Thus, what has been shown and described is a system whereby the need of keeping an inventory of tags and labels is obviated. With the system shown and described the post office is relieved of the burden of having a large number of tags and labels on hand, there is no need for ordering preprinted tags with the delays accompanying therewith, and accuracy and productivity of tray tagging are increased.

What is claimed is:

1. Apparatus for producing tags to identify mail received within a bin of a mail distribution sort plan controlled sorting machine for placement into mail receiving trays and sacks, comprising:

an electronic hand held labeler having a processor having a program and a data base containing a plurality of mail distribution sort plans stored in the memory thereof that corresponds to the sort plan of the sorting machine, a keyboard and a printer having unprinted postal tags in communication with said processor whereby upon a mail distribution sort plan being selected and bin data being entered through said keyboard, said processor will cause said printer to print a postal tag with information based upon said selected sort plan and bin data or multiple tags with information based upon said selected sort plan and bin data.

2. The apparatus of claim 1 wherein said hand held labeler includes a scanner whereby upon scanning a code said labeler prints a tag in response thereto.

3. The apparatus of claim 2 wherein said code is a bar code.

* * * * *